US010111576B2

(12) United States Patent
Boyer

(10) Patent No.: US 10,111,576 B2
(45) Date of Patent: Oct. 30, 2018

(54) BOTTLE WASHER ASSEMBLY FOR DISHWASHER APPLIANCE

(71) Applicant: General Electric Company, Schenectady, NY (US)

(72) Inventor: Joel Charles Boyer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 331 days.

(21) Appl. No.: 14/988,792

(22) Filed: Jan. 6, 2016

(65) Prior Publication Data

US 2017/0188790 A1 Jul. 6, 2017

(51) Int. Cl.

| | |
|---|---|
| ***A47L 15/50*** | (2006.01) |
| ***A47L 15/23*** | (2006.01) |
| ***A47L 15/42*** | (2006.01) |

(52) U.S. Cl.

CPC ..... *A47L 15/508* (2013.01); *A47L 15/4221* (2013.01); *A47L 15/505* (2013.01)

(58) Field of Classification Search

CPC .... A47L 15/508; A47L 15/23; A47L 15/4219; A47L 15/4259; A47L 15/4261; A47L 15/4293; A47L 15/502; A47L 15/507

USPC ..... 134/170

See application file for complete search history.

(56) References Cited

U.S. PATENT DOCUMENTS

| | | | | |
|---|---|---|---|---|
| 6,612,009 | B1 | 9/2003 | Laszczewski, Jr. et al. | |
| 2004/0108283 | A1* | 6/2004 | Miilu | A47L 15/505 211/41.9 |
| 2006/0289679 | A1* | 12/2006 | Johnson | B05B 1/3046 239/333 |
| 2008/0271765 | A1* | 11/2008 | Burrows | A47L 15/508 134/172 |
| 2012/0291827 | A1* | 11/2012 | Buddharaju | A47L 15/4278 134/198 |

FOREIGN PATENT DOCUMENTS

| | | |
|---|---|---|
| EP | 0997100 B1 | 5/2004 |
| EP | 2225996 A1 | 9/2010 |

* cited by examiner

*Primary Examiner* — Michael E Barr
*Assistant Examiner* — Tinsae B Ayalew
(74) *Attorney, Agent, or Firm* — Dority & Manning, P.A.

(57) ABSTRACT

Bottle washer assemblies for dishwasher appliances are provided. A bottle washer assembly includes a main conduit defining a main passage for flowing wash fluid therethrough, and a tine base connected to the main conduit, the tine base defining a base passage in fluid communication with the main passage for flowing wash fluid from the main passage therethrough. The bottle washer assembly further includes a check valve disposed within the base passage, the check valve movable between an open position and a closed position, wherein in the open position the check valve permits wash fluid flow therepast and in the closed position the check valve prevents wash fluid flow therepast. The bottle washer assembly further includes a spray tine, the spray tine comprising a conduit defining a passage for flowing wash fluid therethrough, the spray tine removably connectable to the tine base.

17 Claims, 8 Drawing Sheets

BOTTLE WASHER ASSEMBLY FOR DISHWASHER APPLIANCE

FIELD OF THE INVENTION

The present subject matter relates generally to dishwasher appliances, and more particularly to bottle washer assemblies for use in dishwasher appliances.

BACKGROUND OF THE INVENTION

Dishwasher appliances generally include a tub that defines a wash chamber therein. Various spray assemblies may be disposed within the wash chamber. During operation of the dishwasher appliances, the spray assemblies direct wash fluid towards articles within rack assemblies in the wash chamber. Thus, the spray assemblies provide multiple outlets for directing wash fluid onto articles within the rack assemblies during operation of the dishwasher appliances.

In certain dishwasher appliances, a bottle washer assembly is provided as one of the spray assemblies. The bottle washer assembly generally includes spray tines through which wash fluid is flowed. Suitable articles, such as bottles, cups, glasses, etc., are provided on the bottle washer assembly such that, for example, an article generally surrounds a spray tine. Wash fluid ejected from the spray tine contacts and cleans the inside surface of the article.

One issue with many presently known bottle washer assemblies is the constant flow of wash fluid through and ejected from the assemblies. In cases when the bottle washer assemblies are not being utilized, wash fluid is still flowed through the bottle washer assemblies. This flow thus reduces the amount of wash fluid and the flow rate of wash fluid available to other spray assemblies in the dishwasher appliance, such as the lower, mid-level and upper spray assemblies.

An additional issue with many presently known bottle washer assemblies is the stationary nature of the spray tine in a typically vertical position. In cases when the bottle washer assemblies are not being utilized, the spray tines are maintained in their stationary positions and may thus be obtrusive to users attempting to load articles in the dishwasher assembly around the bottle washer assemblies.

Accordingly, improved bottle washer assemblies are desired in the art. In particular, bottle washer assemblies having flow restriction features and which can be positioned unobtrusively when not in use would be advantageous.

BRIEF DESCRIPTION OF THE INVENTION

In accordance with one embodiment, a bottle washer assembly for a dishwasher appliance is provided. The bottle washer assembly includes a main conduit defining a main passage for flowing wash fluid therethrough, and a tine base connected to the main conduit, the tine base defining a base passage in fluid communication with the main passage for flowing wash fluid from the main passage therethrough. The bottle washer assembly further includes a check valve disposed within the base passage, the check valve movable between an open position and a closed position, wherein in the open position the check valve permits wash fluid flow therepast and in the closed position the check valve prevents wash fluid flow therepast. The bottle washer assembly further includes a spray tine, the spray tine comprising a conduit defining a passage for flowing wash fluid therethrough, the spray tine removably connectable to the tine base.

In accordance with another embodiment, a dishwasher appliance is provided. The dishwasher appliance includes a tub defining a wash chamber, a rack assembly disposed within the wash chamber of the tub, a first spray assembly positioned adjacent the rack assembly, and a second spray assembly positioned adjacent the rack assembly. The second spray assembly is a bottle washer assembly. The bottle washer assembly includes a main conduit defining a main passage for flowing wash fluid therethrough, and a tine base connected to the main conduit, the tine base defining a base passage in fluid communication with the main passage for flowing wash fluid from the main passage therethrough. The bottle washer assembly further includes a check valve disposed within the base passage, the check valve movable between an open position and a closed position, wherein in the open position the check valve permits wash fluid flow therepast and in the closed position the check valve prevents wash fluid flow therepast. The bottle washer assembly further includes a spray tine, the spray tine comprising a conduit defining a passage for flowing wash fluid therethrough, the spray tine removably connectable to the tine base.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
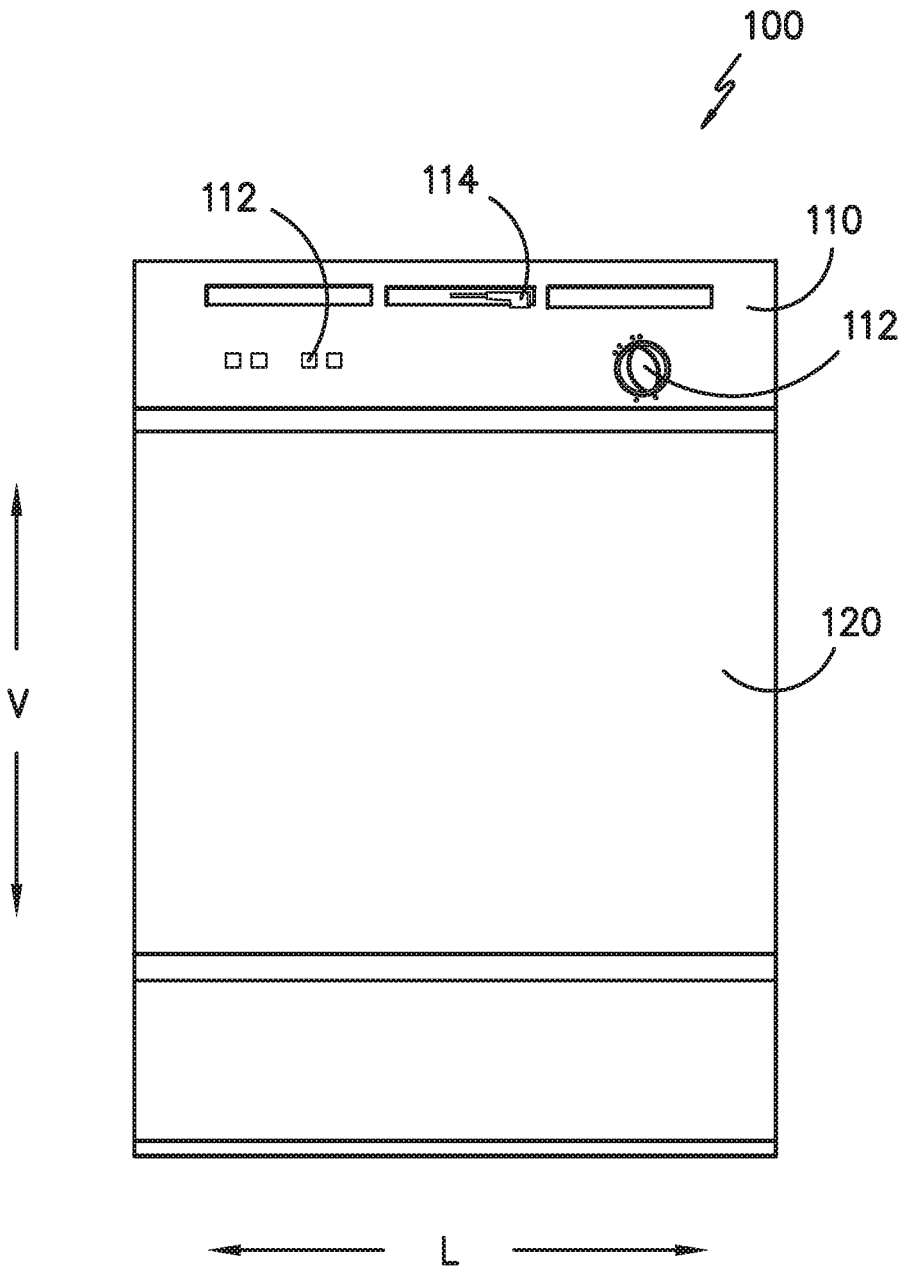
FIG. 1 provides a front elevation view of a dishwasher appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
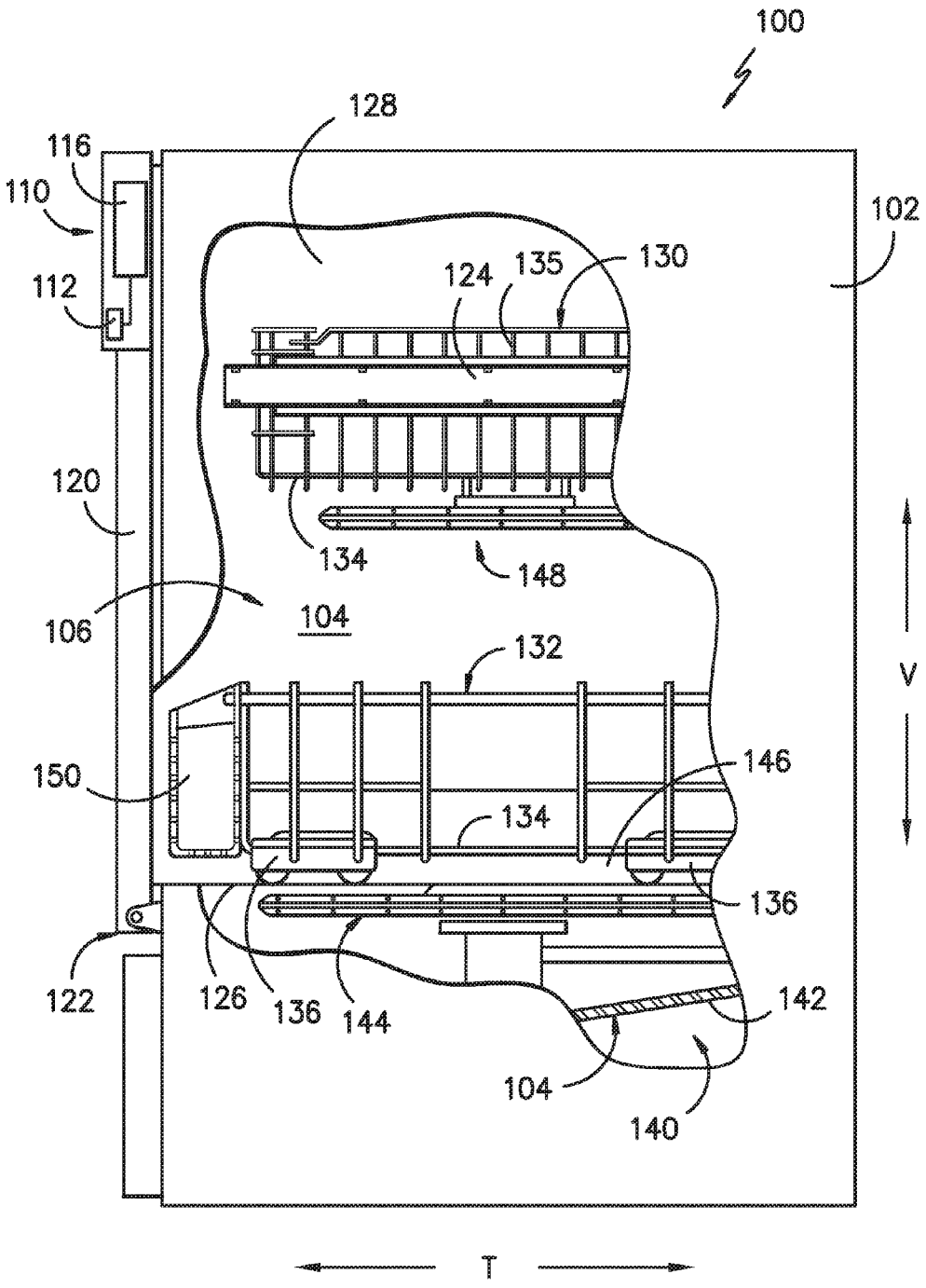
FIG. 2 provides a partial side section view of a dishwasher appliance in accordance with one embodiment of the present disclosure.

FIGS. 1 and 2 depict a dishwasher appliance 100 according to an exemplary embodiment of the present subject matter. Dishwasher appliance 100 defines a vertical direction V, a lateral direction L (FIG. 1) and a transverse direction T (FIG. 2). The vertical, lateral, and transverse directions V, L, and T are mutually perpendicular and form an orthogonal direction system.

Dishwasher appliance 100 includes a chassis or cabinet 102 having a tub 104. Tub 104 defines a wash chamber 106 and includes a front opening (not shown) and a door 120 hinged at its bottom 122 for movement between a normally closed vertical position (shown in FIGS. 1 and 2), wherein wash chamber 106 is sealed shut for washing operation, and a horizontal open position for loading and unloading of articles from dishwasher appliance 100. A latch 114 is used to lock and unlock door 120 for access to chamber 106.

Slide assemblies 124 are mounted on opposing tub sidewalls 128 to support and provide for movement of an upper rack assembly 130. Lower guides 126 are positioned in opposing manner of the sides of chamber 106 and provide a ridge or shelf for roller assemblies 136 so as to support and provide for movement of a lower rack assembly 132. Each of the upper and lower rack assemblies 130 and 132 is fabricated into lattice structures including a plurality of elongated members 134 and 135 that extend in lateral (L), transverse (T), and/or vertical (V) directions. Each rack assembly 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assemblies 124 and roller assemblies 136 that carry the upper and lower rack assemblies 130 and 132, respectively. A silverware basket 150 may be removably attached to the lower rack assembly 132 for placement of silverware, small utensils, and the like, that are too small to be accommodated by the upper and lower rack assemblies 130, 132.

Dishwasher appliance 100 also includes a lower spray assembly 144 that is rotatably mounted within a lower region 146 of the wash chamber 106 and above a tub sump portion 142 so as to rotate in relatively close proximity to lower rack assembly 132. A spray arm or mid-level spray assembly 148 is located in an upper region of the wash chamber 106 and may be located in close proximity to upper rack assembly 130. Additionally, an upper spray assembly (not shown) may be located above the upper rack assembly 130 and mounted to an upper wall of tub 104.

Lower and mid-level spray assemblies 144, 148 and the upper spray assembly are fed by a fluid circulation assembly for circulating water and wash fluid in the tub 104. Portions of the fluid circulation assembly may be located in a machinery compartment 140 located below tub sump portion 142 of tub 104, as generally recognized in the art. Each spray assembly includes an arrangement of discharge ports or orifices for directing washing liquid onto dishes or other articles located in upper and lower rack assemblies 130, 132, respectively. The arrangement of the discharge ports in at least the lower spray assembly 144 provides a rotational force by virtue of washing fluid flowing through the discharge ports. The resultant rotation of lower spray assembly 144 provides coverage of dishes and other articles with a washing spray.

Dishwasher appliance 100 is further equipped with a controller 116 to regulate operation of dishwasher appliance 100. Controller 116 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 116 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. Typically, the controller 116 includes a user interface panel 112 through which a user may select various operational features and modes and monitor progress of the dishwasher appliance 100. In one embodiment, user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. User interface panel 112 may include a display component, such as a digital or analog display device designed to provide operational feedback to a user. User interface panel 112 may be in communication with controller 116 via one or more signal lines or shared communication busses.

It should be appreciated that the present subject matter is not limited to any particular style, model, or configuration of dishwasher appliance. Thus, the exemplary embodiment depicted in FIGS. 1 and 2 is provided for illustrative purposes only. For example, different locations may be provided for a user interface 112, different configurations may be provided for upper and lower rack assemblies 130, 132 and/or lower and mid-level spray assemblies 144, 148, and other differences may be applied as well.

Figure 3:
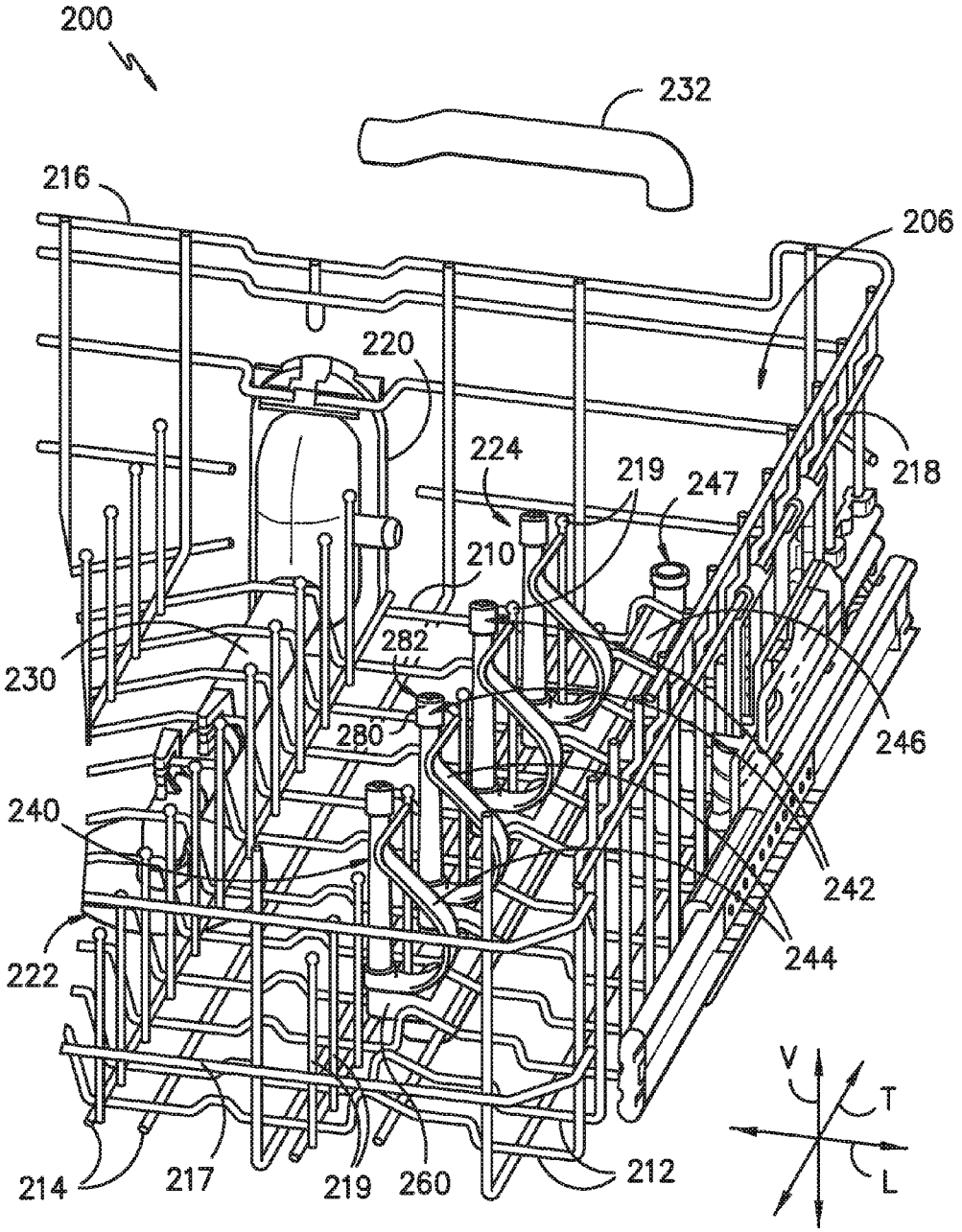
FIGS. 3 and 4 provide partial perspective views of a rack assembly in accordance with embodiments of the present disclosure.
Figure 4:
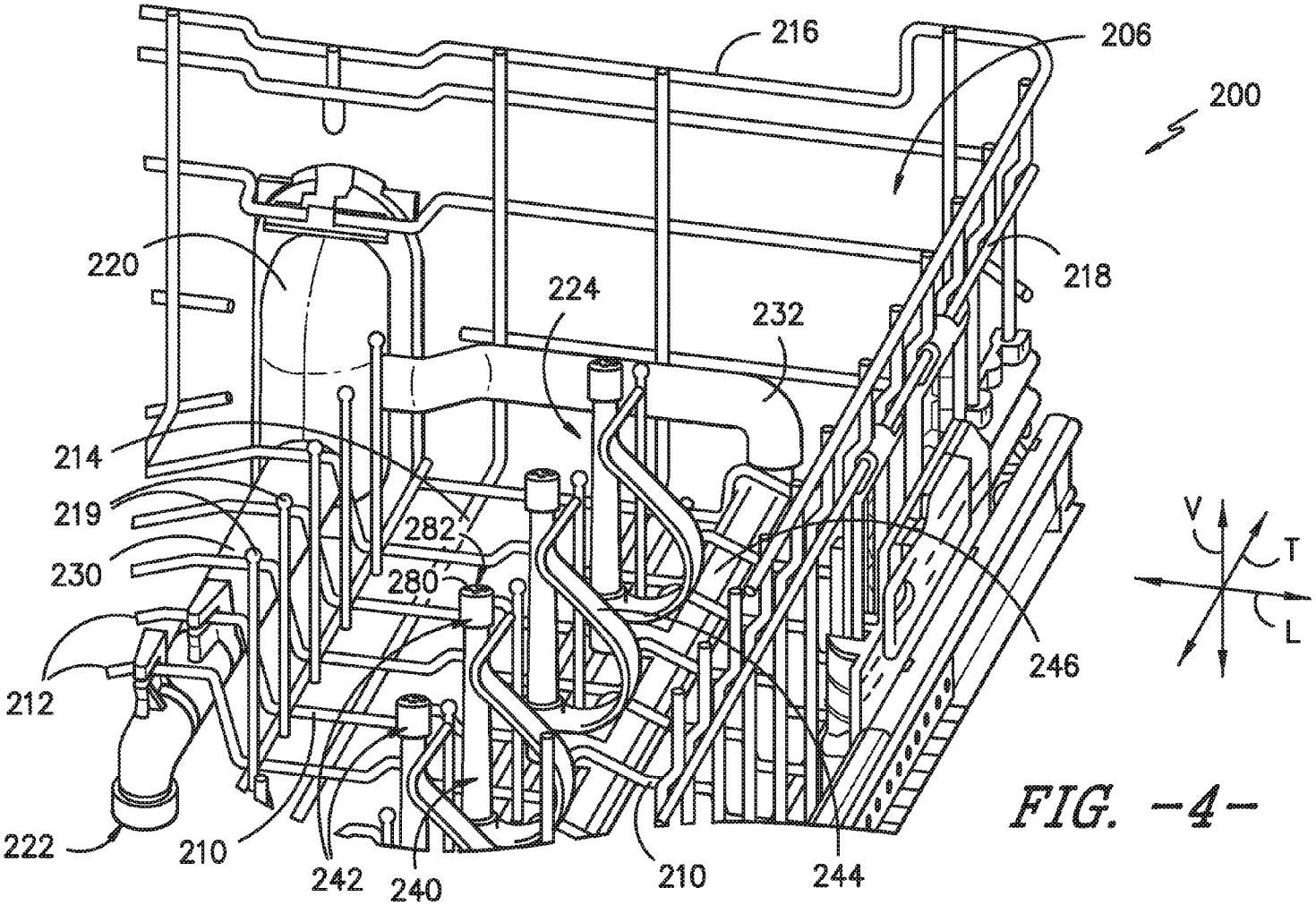
Figure 5:
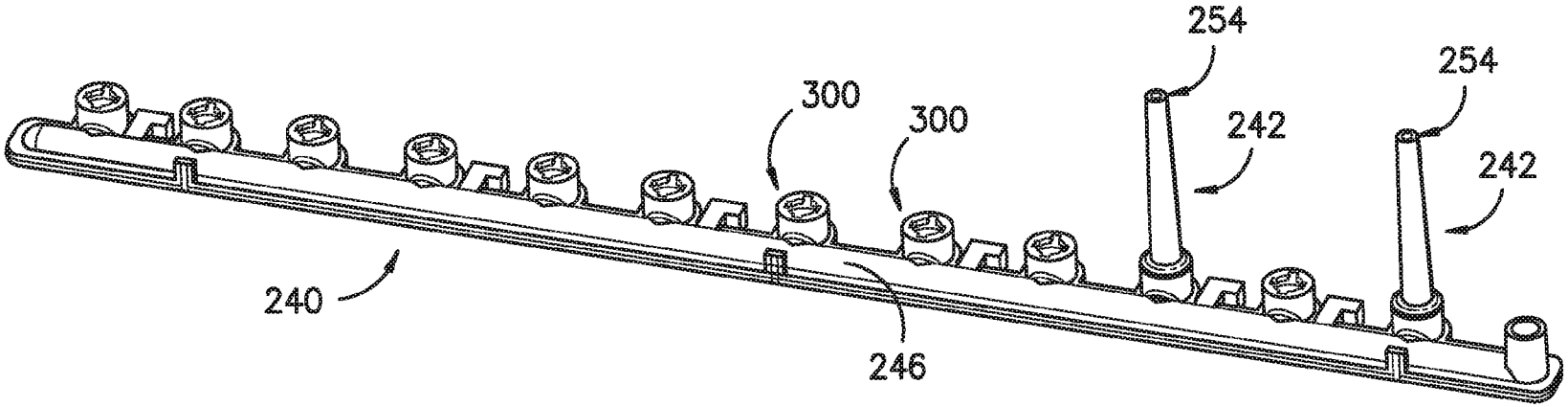
FIG. 5 provides a perspective view of a bottle washer assembly in accordance with one embodiment of the present disclosure.
Figure 6:
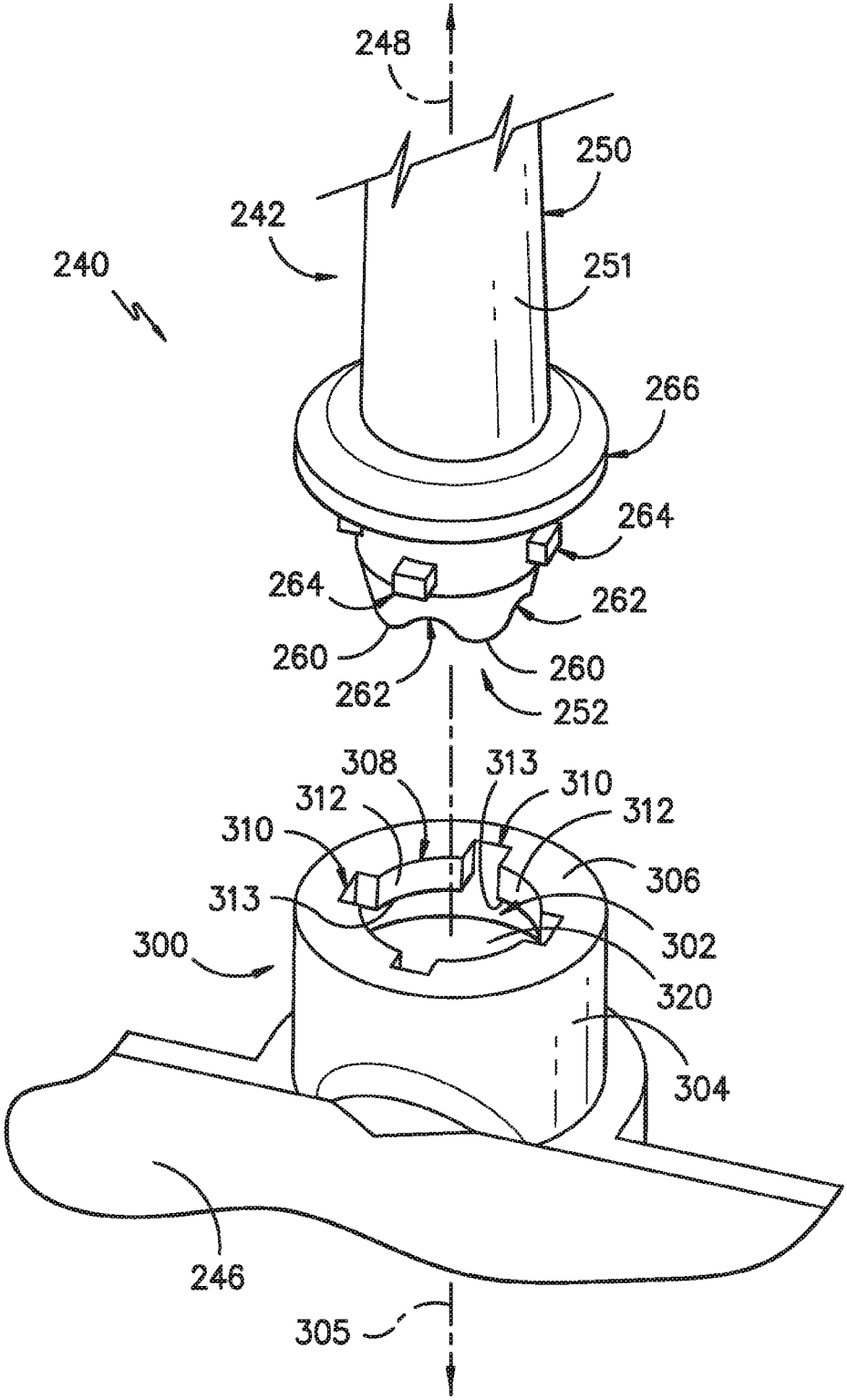
FIG. 6 provides an exploded perspective view of components of a bottle washer assembly in accordance with one embodiment of the present disclosure.

FIGS. 3 and 4 illustrate partial perspective views of a rack assembly 200 according to an exemplary embodiment of the present subject matter. Rack assembly 200 may be used in any suitable dishwasher appliance. As an example, rack assembly 200 may be utilized in dishwasher appliance 100, e.g., as upper rack assembly 130 (FIG. 2) or alternatively as lower rack assembly 132. Rack assembly 200 may generally include features for directing flows of wash fluid into the wash chamber 106, such as generally towards rack assembly 200, as discussed in greater detail below.

As may be seen in FIGS. 3 and 4, rack assembly 200 defines an interior volume 206. In particular, a bottom wall 210, a back wall 216, a front wall 217 and side walls 218 (only one of which is shown) of rack assembly 200 may assist with defining interior volume 206 of rack assembly 200. Thus, interior volume 206 of rack assembly 200 may be defined between bottom wall 210, back wall 216, front wall 217 and side walls 218 of rack assembly 200. Articles for washing, such as cups, bowls, bottles, etc., may be placed or positioned within interior volume 206 of rack assembly 200 such that the articles for washing are supported by rack assembly 200 during operation of dishwasher appliance 100.

Rack assembly 200 can also include a plurality of tines 219, which as shown are fixed tines but alternatively may be rotatable tines, for assisting with supporting articles within interior volume 206 of rack assembly 200. Fixed tines 219 are mounted to bottom wall 210 of rack assembly 200 and extend into interior volume 206 of rack assembly 200, e.g., upwardly along the vertical direction V. In particular, as shown in FIGS. 3 and 4, bottom wall 210 may include a series of lateral members 212 fixed to a series of transverse members 214. Each lateral member of lateral members 212 extends along the lateral direction L. Lateral members 212 are also spaced apart from one another along the transverse direction T. Similarly, each transverse member of transverse members 214 extend along the transverse direction T. Transverse members 214 are also spaced apart from one another along the lateral direction L. Thus, lateral members 212 and transverse members 214 form a lattice structure for containing articles within rack assembly 200. Fixed tines 219 may be mounted or fixed (e.g., welded) to lateral members 212 and/or transverse members 214 of bottom wall 210 of rack assembly 200 and extend into interior volume 206 of rack assembly 200, e.g., upwardly along the vertical direction V, from bottom wall 210.

Rack assembly 200 further includes a first spray assembly 222 and a second spray assembly 224. First and second spray assemblies 222, 224 are positioned and oriented for directing respective flows of wash fluid into wash chamber 106, such as towards interior volume 206 of rack assembly 200. The flows of wash fluid from first and second spray assemblies 222, 224 can assist with cleaning articles within interior volume 206 of rack assembly 20X), as will be understood by those skilled in the art. Thus, rack assembly 200 includes features for, e.g., selectively, directing multiple flows of washing fluid into interior volume 206 of rack assembly 200.

First spray assembly 222 is positioned and/or oriented for directing a first flow of wash fluid towards or into rack assembly 200. In the exemplary embodiment shown in FIGS. 3 and 4, first spray assembly 222 may be a spray arm, such as mid-level spray assembly 148 of dishwasher appliance 100. Thus, first spray assembly 222 may be a spray arm rotatably mounted to rack assembly 200 at bottom wall 210 of rack assembly 200. In particular, first spray assembly 222 may be positioned below bottom wall 210 of rack assembly 200, e.g., along the vertical direction V, and direct the first flow of wash fluid towards or into rack assembly 200 through bottom wall 210.

Second spray assembly 224 is positioned and/or oriented for directing a second flow of wash fluid towards or into rack assembly 200. In particular, as shown in FIGS. 3 and 4, second spray assembly 224 is a bottle washer assembly 240. Bottle washer assembly 240 is mounted to rack assembly 200 at bottom wall 210 of rack assembly 200. Bottle washer assembly 240 includes one or more spray tines 242. Articles, and in particulars bottles (such as baby bottles), cups, glasses, etc., may be positioned on and/or over spray tines 242. Spray tines 242 are mounted to a main conduit 246 of the bottle washer assembly 240 and can extend into interior volume 206 of rack assembly 200. e.g., upwardly along the vertical direction V. In particular, spray tines 242 of bottle washer assembly 240 may be distributed between fixed tines 219 of bottom wall 210. For example, each spray tine 242 of bottle washer assembly 240 may be positioned between respective pairs of fixed tines 219 as shown in FIGS. 3 and 4.

Spray tines 242 may assist with supporting articles within interior volume 206 of rack assembly 200. In addition, each spray tine 242 may emit a stream of wash fluid during operation of bottle washer assembly 240. The stream of wash fluid is directed against or onto an article positioned over or on each respective one of spray tines 242. In such a manner, bottles and other containers may be washed or cleaned during operation of dishwasher appliance 100.

Bottle washer assembly 240 also includes one or more clips 244. Each clip 244 is positioned and/or mounted to a respective one of spray tines 242. Clips 244 engage articles disposed on or over spray tines 242 and hinder or prevent such articles from moving during operation of bottler washer assembly 240. Thus, as an example, when a stream of fluid from one of spray tines 242 impacts a bottle disposed over the one of spray tines 242, an associated one of clips 244 hinders or prevents the bottle from being ejected off the one of spray tines 242 by the stream of fluid.

To provide wash fluid to first spray assembly 222 and second spray assembly 224, rack assembly 200 includes a supply conduit 220. Supply conduit 220 is configured for receiving wash fluid during operation of an associated dishwasher appliance 100 and directing such wash fluid to first spray assembly 222 and/or second spray assembly 224. For example, supply conduit 220 may be in fluid communication with the fluid circulation assembly of dishwasher appliance 100 when rack assembly 200 is in a closed position. Thus, the fluid circulation assembly of dishwasher appliance 100, e.g. a pump of the fluid circulation assembly, may direct wash fluid from tub sump portion 142 of tub 104 to supply conduit 220 during operation of dishwasher appliance 100.

Supply conduit 220 includes a first segment 230 that extends to or towards first spray assembly 222 and a second segment 232 that extends to or towards second spray assembly 224. First segment 230 of supply conduit 220 directs wash fluid therethrough to first spray assembly 222, e.g., during operation of dishwasher appliance 100. Second segment 232 of supply conduit 220 is configured for directing wash fluid to second spray assembly 224. e.g., during operation of dishwasher appliance 100. (It should be noted that second segment 232 is shown in an exploded position in FIG. 3 for illustrative purposes only).

Referring now to FIGS. 5 through 8, embodiments of bottle washer assemblies 240 in accordance with the present disclosure are illustrated. As discussed, a bottle washer assembly 240 may include one or more spray tines 242, each of which may be in selective fluid communication with main conduit 246, such as with a main passage 247 (see FIG. 3) defined in the main conduit 246. Wash fluid may thus be selectively flowed through each spray tine 242 from the main conduit 246, and may be exhausted from each spray tine 242 generally into the wash chamber 106. The wash fluid may be flowed, for example, from supply conduit 220, such as second segment 232 thereof, into main passage 247 of main conduit 246. The wash fluid in main passage 247 may then be flowed therethrough, and may selectively be flowed into and through spray tines 242 as discussed herein. Advantageously, as discussed herein, one or more spray tines 242 may further be removably connectable to tine bases which are connected to the main conduit 246. Check valves included in the tine bases may selectively allow flow therepast to the associated spray tines 242. For example, as discussed herein, check valves may permit wash fluid flow therepast when the spray tines 242 are connected to the tine bases, and may prevent wash fluid flow therepast when the spray tines 242 are disconnected from the tine bases. When disconnected, the spray tines 242 can advantageously be removed from the wash chamber 106 and cabinet 102 generally for external storage. Accordingly, spray tines 242 in accordance with the present disclosure are advantageously unobtrusive when not needed. Further, due to the use of check valves as discussed herein, bottle washer assemblies 240 advantageously do not utilize excess wash fluid when the wash fluid is not required for use with a connected spray tine 242.

As illustrated, bottle washer assembly 240 thus includes one or more spray tines 242 and one or more tine bases 300. Tine bases 300 in accordance with the present disclosure are connected to the main conduit 246, and may each define a base passage 302 therethrough. The base passages 302 may thus be in fluid communication with the main passage 247, such that wash fluid flowing through the main passage 247 may flow from the main passage 247 into the one or more base passages 302.

A tine base 300 may, as illustrated, further include one or more sidewalls 304 and a face 306. In exemplary embodiments, a tine base 300 may include a single cylindrical sidewall 304. Sidewalls 304 may, as illustrated, extend along a longitudinal axis 305. The face 306 may, for example, be oriented generally transverse to the sidewall(s) 304, and may define an end of the tine base 300 that is distal from an end connected to the main conduit 246.

Further, face 306 may define an aperture 308 through which wash fluid may flow. Wash fluid may thus, when flowed through base passage 302, be exhausted through aperture 308. As further illustrated, face 306 may additionally define one or more locating slots 310. The locating slots 310 may, as illustrated, extend from aperture 308. In exemplary embodiments, the locating slots 310 may be spaced apart, such as circumferentially about the longitudinal axis 305 as illustrated.

A tine base 300 may additionally include a plurality of ramps 312. Each ramp 312 may extend from the face 306 into the base passage 302. The ramps 312 may be spaced apart, such as circumferentially about the longitudinal axis 305 as illustrated. Further, each ramp 312 may be circumferentially located between neighboring locating slots 310, and each locating slot 310 may be circumferentially located between neighboring ramps 312. Each ramp 312 may be associated with a locating slot 310, and a ramp face 313 of each ramp 312 may be angled relative to a circumferential direction about the longitudinal axis 305.

Figure 7:
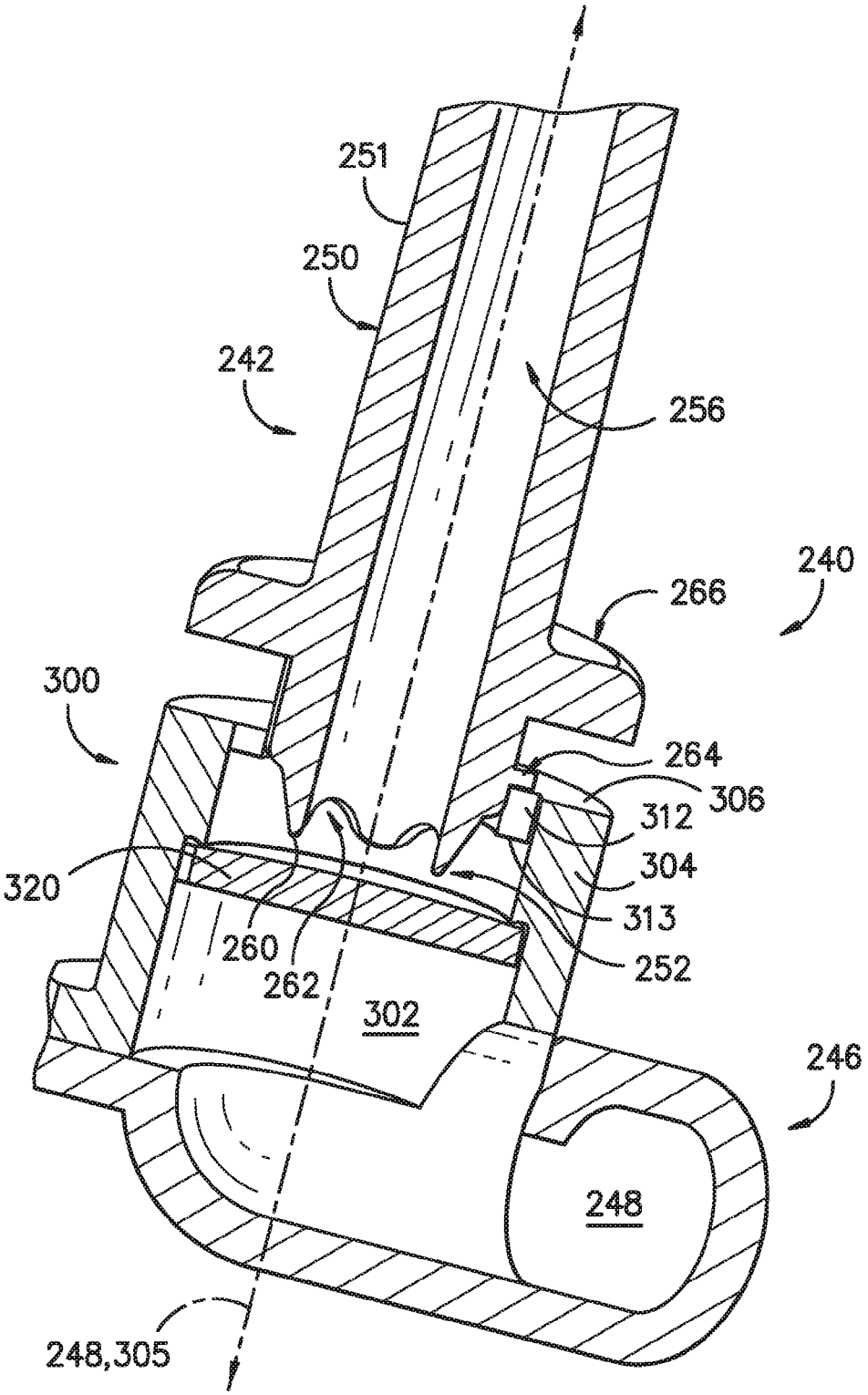
FIG. 7 provides a sectional view of components of a bottle washer assembly, with a check valve disposed in a closed position, in accordance with one embodiment of the present disclosure.
Figure 8:
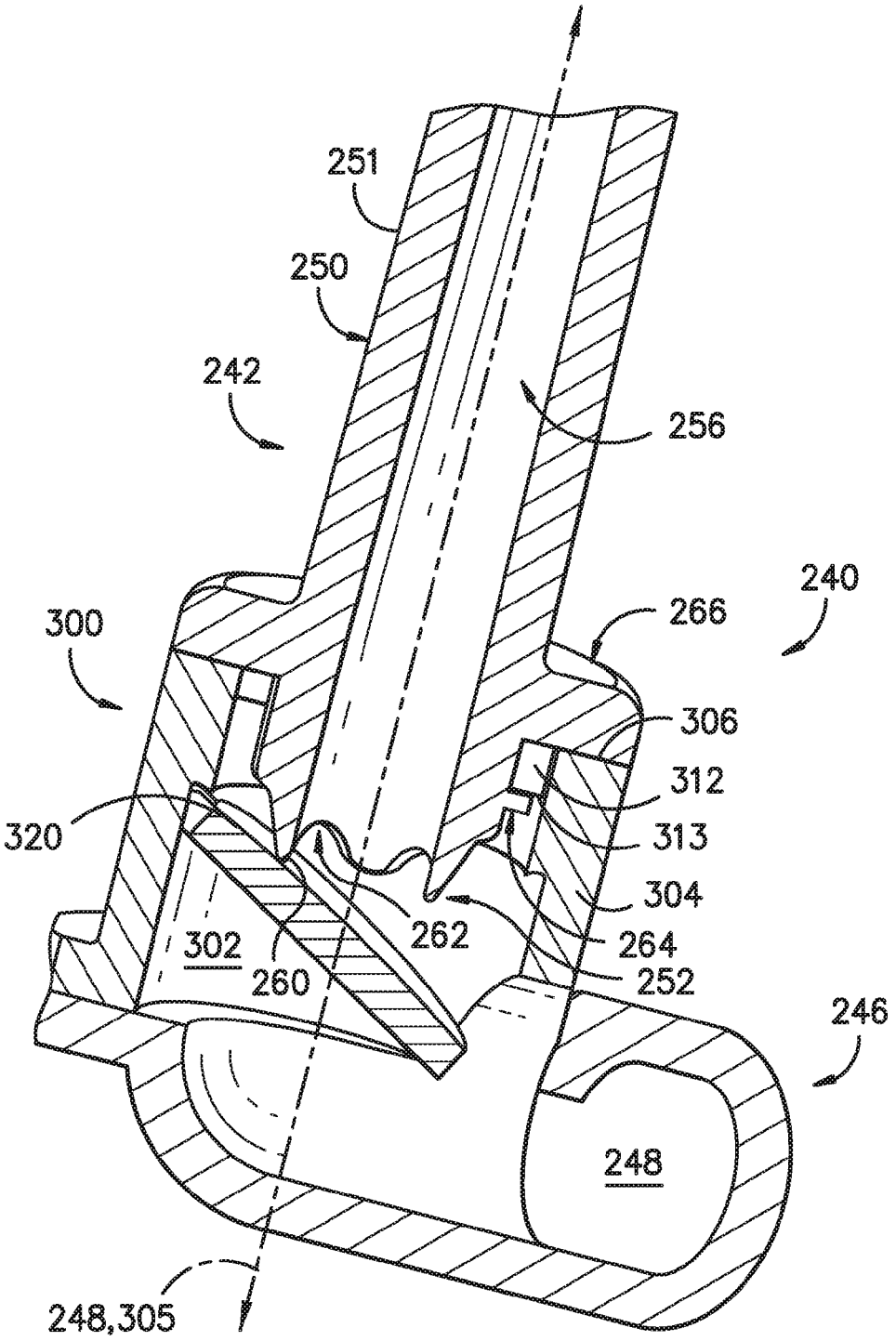
FIG. 8 provides a sectional view of components of a bottle washer assembly, with a check valve disposed in an open position, in accordance with one embodiment of the present disclosure.

As best illustrated in FIGS. 7 and 8, a bottle washer assembly 240 may additionally include one or more check valves 320. Each check valve 320 may be disposed within a tine base 300, such as within the base passage 302 thereof. Further, a check valve 320 in accordance with the present disclosure may be movable between a closed position, as illustrated in FIG. 7, and an open position, as illustrated in FIG. 8. In the open position, the check valve 320 may permit wash fluid flow therepast. Accordingly, wash fluid flowed into the base passage 302 may flow past or through the check valve 320 and then be exhausted from the tine base 30X), such as through the aperture 308 thereof. In the closed position, the check valve 320 may prevent wash fluid flow therepast. Accordingly, wash fluid flowed into the base passage 302 may be prevented from flowing past or through the check valve 320, such that no or minimal wash fluid is exhausted from the tine base 300, such as through the aperture 308 thereof.

A check valve 320 in accordance with the present disclosure is, in exemplary embodiments, a passive check valve 320. Accordingly, movement of the check valve 320 between the open and closed positions is caused by other components or forces, such as contact with a spray tine 242 to open a check valve 320 or contact with wash fluid to close a check valve 320, and/or caused by the material properties of the check valve 320. In alternative embodiments, however, check valve 320 may be an active check valve, such as a solenoid valve or other suitable active valve that is itself actively movable between open and closed positions.

In exemplary embodiments as shown, check valve 320 may for example be a disk. The check valve 320, such as in exemplary embodiments the disk, may be pivotable between the open and closed positions. For example, the check valve 320 may be connected to the sidewall 304 and pivotable about the connection point, as illustrated. In exemplary embodiments, the check valve 320 may be formed from a pliable material, such as a silicon or rubber, which may facilitate the movement of the check valve 320 between the open and closed positions.

Referring still to FIGS. 5 through 8, a spray tine 242 in accordance with the present disclosure may be removably connectable to a tine base 300. A spray tine 242 may, for example, include a conduit 250. The conduit 250 may extend between a first end 252 and a second end 254, such as along a longitudinal axis 248. When the spray tine 242 is connected to the tine base 300, the longitudinal axes 248, 300 may, for example, be coaxial. Conduit 250 may further define a passage 256 extending therethrough between first end 252 and second end 254. The passage 256 may be in selective fluid communication with the main passage 247 of the main conduit 246 via the base passage 302, as discussed herein. Accordingly, wash fluid may selectively flow from the main passage 247 through the base passage 302 into the passage 256 of the conduit 250 at the first end 252, and exit the passage 256 of the conduit 250 at the second end 254 thereof.

In exemplary embodiments as illustrated in FIG. 8, the connection of the spray tine 242 to the tine base 300 may cause movement of the check valve 320 from the closed position to the open position. For example, as illustrated, the spray tine 242 may contact the check valve 320 when the check valve 320 is in the open position. Further, the spray tine 242 may contact the check valve 320 as the spray tine 242 is being connected to the tine base 300, and this contact may cause movement of the check valve 320 from the closed position to the open position.

First end 252 may thus, as illustrated, extend into the base passage 302 and contact the check valve 320 when the spray tine 242 is connected to the tine base 300, causing movement of the check valve 320 into the open position. For example, as illustrated, spray tine 242 may include a plurality of contact tabs 260 which may define the first end 252. One or more of the contact tabs 260 may, when the spray tine 242 is connected to the tine base 300, contact the check valve 320 and cause movement of the check valve 320 into the open position. The contact tabs 260 may, for example, be spaced apart circumferentially about the longitudinal axis 248. As illustrated, in exemplary embodiments, the contact tabs 260 may be arranged in a waveform pattern, which may extend circumferentially about the longitudinal axis 248.

Recesses 262 may separate the contact tabs 260, and may, for example, further define the waveform pattern as illustrated.

Accordingly, connection of a spray tine 242 to a tine base 300 may cause the associated check valve 320 to move from a closed position to an open position. Further, removal of the spray tine 242 from the tine base 300 may cause the associated check valve 320 to move from an open position to a closed position. For example, when the spray tine 242 is removed, the first end 252 may no longer bias the check valve 320 towards the open position. Accordingly, the material of the check valve 320 and/or the force of wash fluid on the check valve 320 may cause the check valve 320 to return to a closed position. In the closed position, the check valve 320 may generally be seated within the base passage 302 to prevent wash fluid flow therepast, as discussed.

To connect a spray tine 242 to a tine base 300, the first end 252 may be inserted into the base passage 302, such as through the aperture 308. Further, in exemplary embodiments, spray tine 242 may include connecting features for removably locking the spray tine 242 in place and in connection with the tine base 300. For example, spray tine 242 may include a plurality of locating protrusions 264. Each locating protrusion 264 may, for example, extend from the conduit 250, such as from an outer surface 251 thereof, proximate the first end 252. Locating protrusions 264 may, for example, be spaced apart circumferentially about the longitudinal axis 248. Further, the number of locating protrusions 264 may in exemplary embodiments equal the number of locating slots 310, and the spacing of the locating protrusions 264 may equal the spacing of the locating slots 310. The locating protrusions 264 may, when connecting a spray tine 242 to a tine base 300, be insertable through the locating slots 310 and into the base passage 302 to connect the spray tine 242 to the tine base 300.

Further, as discussed, tine base 300 may include a plurality of ramps 312. To connect a spray tine 242 to a tine base 300, the spray tine 242 may, after insertion of the locating protrusions 264 through the locating slots 310, be rotated about the longitudinal axis 248. Such rotation may cause the locating protrusions 264 to each contact a ramp 312, such as the ramp face 313 thereof. Contact by the locating protrusions 264 with the ramps 312, such as with the ramp faces 313 thereof, may connect the spray tine 242 to the tine base 300.

Notably, to disconnect the spray tine 242 from the tine base 300, the above-disclosed connecting details may be reversed. For example, the spray tine 242 may be rotated about the longitudinal axis 248 to separate the locating protrusions 264 from the ramps 312 and align the locating protrusions 264 with the locating slots 310. The locating protrusions 264 and the first end 252 may then be removed from the base passage 302 through the locating slots 310 and aperture 308, respectively.

In exemplary embodiments, spray tine 242 may further include a flange 266 which may extend from the outer surface 251 of the conduit 250. When the spray tine 242 is connected to the tine base 300), the flange 266 may contact the face 306, and may serve to reduce or prevent wash fluid leakage from the aperture 308 and locating slots 310 during operation of the appliance 100.

Referring again briefly to FIGS. 3 and 4, in exemplary embodiments, a spray tine 242 may further include a cap 280. The cap 280 may be mounted to the conduit 250, such as to the second end 254 thereof. Cap 280 may further define a plurality of outlet apertures 282 through which wash fluid may be exhausted from the spray tine 242 into the wash chamber 106. Accordingly, wash fluid may flow from the second end 254 of the conduit into the cap 280, and from the cap 280 into the wash chamber 106 through the outlet apertures 282.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A bottle washer assembly for a dishwasher appliance, the bottle washer assembly comprising:

a main conduit defining a main passage along a longitudinal axis for flowing wash fluid therethrough;

a tine base connected to the main conduit, the tine base defining a base passage in fluid communication with the main passage for flowing wash fluid from the main passage therethrough;

a check valve disposed within the base passage, the check valve movable between an open position and a closed position, wherein in the open position the check valve permits wash fluid flow therepast and in the closed position the check valve prevents wash fluid flow therepast; and a spray tine, the spray tine comprising a conduit defining a passage for flowing wash fluid therethrough, the spray tine removably connectable to the tine base, wherein the spray tine further comprises a plurality of contact tabs arranged in a waveform extending circumferentially about the longitudinal axis to permit wash fluid through a plurality of recesses defined between the plurality of contact tabs, the contact tabs defining a first end of the spray tine.

2. The bottle washer assembly of claim 1, wherein the check valve is pivotable between the open position and the closed position.

3. The bottle washer assembly of claim 1, wherein the spray tine contacts the check valve when the check valve is in the open position.

4. The bottle washer assembly of claim 3, wherein connection of the spray tine to the tine base causes movement of the check valve from the closed position to the open position.

5. The bottle washer assembly of claim 1, wherein the check valve is formed from a pliable material.

6. The bottle washer assembly of claim 1, wherein the tine base comprises a sidewall and a face, the face defining an aperture and a plurality of locating slots, and wherein the spray tine comprises a plurality of locating protrusions, the locating protrusions insertable through the locating slots to connect the spray tine to the tine base.

7. The bottle washer assembly of claim 6, wherein the tine base further comprises a plurality of ramps extending from the face into the base passage, and wherein contact by the locating protrusions with the ramps connects the spray tine to the tine base.

8. The bottle washer assembly of claim 1, wherein the spray tine further comprises a cap, the cap defining a plurality of outlet apertures.

9. The bottle washer assembly of claim 1, further comprising at least one clip.

10. A dishwasher appliance, comprising:

a tub defining a wash chamber;

a rack assembly disposed within the wash chamber of the tub;

a first spray assembly positioned adjacent the rack assembly; and a second spray assembly positioned adjacent the rack assembly, wherein the second spray assembly is a bottle washer assembly, the bottle washer assembly comprising:

a main conduit defining a main passage along a longitudinal axis for flowing wash fluid therethrough;

a tine base connected to the main conduit, the tine base defining a base passage in fluid communication with the main passage for flowing wash fluid from the main passage therethrough;

a check valve disposed within the base passage, the check valve movable between an open position and a closed position, wherein in the open position the check valve permits wash fluid flow therepast and in the closed position the check valve prevents wash fluid flow therepast; and a spray tine, the spray tine comprising a conduit defining a passage for flowing wash fluid therethrough, the spray tine removably connectable to the tine base, wherein the spray tine further comprises a plurality of contact tabs arranged in a waveform extending circumferentially about the longitudinal axis to permit wash fluid through a plurality of recesses defined between the plurality of contact tabs, the contact tabs defining a first end of the spray tine.

11. The dishwasher appliance of claim 10, wherein the check valve is pivotable between the open position and the closed position.

12. The dishwasher appliance of claim 10, wherein the spray tine contacts the check valve when the check valve is in the open position.

13. The dishwasher appliance of claim 10, wherein connection of the spray tine to the tine base causes movement of the check valve from the closed position to the open position.

14. The dishwasher appliance of claim 10, wherein the check valve is formed from a pliable material.

15. The dishwasher appliance of claim 10, wherein the tine base comprises a sidewall and a face, the face defining an aperture and a plurality of locating slots, and wherein the spray tine comprises a plurality of locating protrusions, the locating protrusions insertable through the locating slots to connect the spray tine to the tine base.

16. The dishwasher appliance of claim 15, wherein the tine base further comprises a plurality of ramps extending from the face into the base passage, and wherein contact by the locating protrusions with the ramps connects the spray tine to the tine base.

17. A dishwasher appliance, comprising:

a tub defining a wash chamber;

a rack assembly disposed within the wash chamber of the tub;

a first spray assembly positioned adjacent the rack assembly; and a second spray assembly positioned adjacent the rack assembly, wherein the second spray assembly is a bottle washer assembly, the bottle washer assembly comprising:

a main conduit extending along a transverse direction, the main conduit defining a main passage for flowing wash fluid therethrough;

a plurality of tine bases connected to the main conduit, each tine base defining a base passage in fluid communication with the main passage for flowing wash fluid laterally from the main passage and therethrough;

a plurality of check valves, each check valve being disposed within a corresponding base passage of a tine base of the plurality of tine bases, each check valve being movable between an open position and a closed position, wherein in the open position the check valve permits wash fluid flow therepast and in the closed position the check valve prevents wash fluid flow therepast; and a plurality of spray tines, each spray tine comprising a conduit defining a passage for flowing wash fluid therethrough, each spray tine being removably connectable to a corresponding tine base of the plurality of tine bases, wherein at least one spray tine of the plurality of spray tines further comprises a plurality of contact tabs arranged in a waveform extending circumferentially about a longitudinal axis to permit wash fluid through a plurality of recesses defined between the plurality of contact tabs, the contact tabs defining a first end of the at least one spray tine of the plurality of spray tines.

* * * * *